US010964300B2

(12) United States Patent
Xiao

(10) Patent No.: US 10,964,300 B2
(45) Date of Patent: Mar. 30, 2021

(54) AUDIO SIGNAL PROCESSING METHOD AND APPARATUS, AND STORAGE MEDIUM THEREOF

(71) Applicant: GUANGZHOU KUGOU COMPUTER TECHNOLOGY CO., LTD., Guangzhou (CN)

(72) Inventor: Chunzhi Xiao, Guangzhou (CN)

(73) Assignee: Guangzhou Kugou Computer Technology Co., LTD., Guangzhou (CN)

( * ) Notice: Subject to any disclaimer, the term of this patent is extended or adjusted under 35 U.S.C. 154(b) by 0 days.

(21) Appl. No.: 16/617,900

(22) PCT Filed: Nov. 16, 2018

(86) PCT No.: PCT/CN2018/115928
§ 371 (c)(1),
(2) Date: Nov. 27, 2019

(87) PCT Pub. No.: WO2019/101015
PCT Pub. Date: May 31, 2019

(65) Prior Publication Data

US 2020/0143779 A1 May 7, 2020

(30) Foreign Application Priority Data

Nov. 21, 2017 (CN) ..... 201711168514.8

(51) Int. Cl.
*G10H 1/36* (2006.01)

(52) U.S. Cl.
CPC ..... *G10H 1/366* (2013.01); *G10H 2210/005* (2013.01); *G10H 2210/066* (2013.01)

(58) Field of Classification Search
CPC ..... G10L 25/66; G10L 21/013; G10H 3/125; G10H 2210/601; G10H 2250/135;
(Continued)

(56) References Cited

U.S. PATENT DOCUMENTS 5,621,182 A 4/1997 Matsumoto
5,986,198 A * 11/1999 Gibson ..... G10H 1/20 84/603

(Continued)

FOREIGN PATENT DOCUMENTS

CN 1294782 A 5/2001
CN 1402592 A 3/2003

(Continued)

OTHER PUBLICATIONS

International Searching Authority, "International Search Report and Written Opinion Re PCT/CN2018/115928", dated Dec. 19, 2018, p. 19 Published in: CN.

(Continued)

*Primary Examiner* — Marlon T Fletcher
(74) *Attorney, Agent, or Firm* — Neugeboren O'Dowd PC

(57) ABSTRACT

An audio signal processing method, belongs to the field of terminal technologies. The audio signal processing method includes: acquiring a first audio signal of a target song sung by a user; extracting timbre information of the user from the first audio signal; acquiring intonation information of a standard audio signal of the target song; and generating a second audio signal of the target song based on the timbre information and the intonation information.

15 Claims, 3 Drawing Sheets

(58) Field of Classification Search
CPC ..... G10H 1/0033; G10H 1/12; G10H 1/365; G10H 2240/131; G10H 2240/145; G10H 2250/055; G10H 2250/285; G10H 2210/056; G10H 2210/086; G10H 1/36; G10H 2210/011; G10H 2210/041; G10H 2210/051; G10H 2210/061; G10H 2210/076; G10H 2210/105; G10H 2250/481; G10H 2250/501; G10H 2250/595; G10H 2250/615; G10H 3/12
See application file for complete search history.

(56) References Cited

U.S. PATENT DOCUMENTS

| | | | | |
|---|---|---|---|---|
| 6,046,395 | A * | 4/2000 | Gibson | G10H 1/20 84/603 |
| 6,304,846 | B1 * | 10/2001 | George | G10L 13/033 704/205 |
| 6,336,092 | B1 * | 1/2002 | Gibson | G10H 1/366 704/207 |
| 7,243,073 | B2 | 7/2007 | Yeh et al. | |
| 8,756,061 | B2 * | 6/2014 | Kalinli | G10L 15/04 704/254 |
| 2002/0159607 | A1 | 10/2002 | Ford et al. | |
| 2007/0131094 | A1 * | 6/2007 | Kemp | G06F 16/632 84/609 |
| 2009/0185693 | A1 | 7/2009 | Johnston et al. | |
| 2009/0306797 | A1 * | 12/2009 | Cox | G06F 16/683 700/94 |
| 2014/0114655 | A1 * | 4/2014 | Kalinli-Akbacak | G10L 25/63 704/231 |
| 2015/0073784 | A1 * | 3/2015 | Gao | G10L 19/12 704/223 |
| 2017/0103748 | A1 * | 4/2017 | Weissberg | G10L 15/063 |
| 2017/0148464 | A1 * | 5/2017 | Zhang | G10L 15/1815 |
| 2017/0206913 | A1 * | 7/2017 | Nahman | G10L 25/63 |
| 2017/0272863 | A1 | 9/2017 | Mentz | |
| 2020/0112812 | A1 | 4/2020 | Liu | |
| 2020/0211572 | A1 * | 7/2020 | Xu | H04L 67/306 |

FOREIGN PATENT DOCUMENTS

| | | | |
|---|---|---|---|
| CN | 1719514 | A | 1/2006 |
| CN | 1791285 | A | 6/2006 |
| CN | 101645268 | A | 2/2010 |
| CN | 101695151 | A | 4/2010 |
| CN | 101878416 | A | 11/2010 |
| CN | 105900170 | A | 11/2010 |
| CN | 101902679 | A | 12/2010 |
| CN | 102568470 | A | 7/2012 |
| CN | 102883245 | A | 1/2013 |
| CN | 103237287 | A | 8/2013 |
| CN | 103377655 | A | 10/2013 |
| CN | 103854644 | A | 6/2014 |
| CN | 104103279 | A | 10/2014 |
| CN | 104464725 | A | 3/2015 |
| CN | 104581602 | A | 4/2015 |
| CN | 105788612 | A | 7/2016 |
| CN | 104091601 | A | 8/2016 |
| CN | 105869621 | A | 8/2016 |
| CN | 105872253 | A | 8/2016 |
| CN | 106228973 | A | 12/2016 |
| CN | 106652986 | A | 5/2017 |
| CN | 107040862 | A | 8/2017 |
| CN | 107077849 | A | 8/2017 |
| CN | 107249080 | A | 10/2017 |
| CN | 107863095 | A | 3/2018 |
| CN | 108156561 | A | 6/2018 |
| CN | 108156575 | A | 6/2018 |
| CN | 109036457 | A | 12/2018 |
| KR | 1020170092313 | A | 8/2017 |
| WO | 2017165968 | A1 | 10/2017 |

OTHER PUBLICATIONS

CNIPA, "Office Action Re Chinese Patent Application No. 201711436811.6", dated May 5, 2019, p. 11 Published in: CN.
Chao, Wang, "The Study of Virtual Multichannel Surround Sound Reproduction Technology", "Dissertation Submitted to Shanghai Jiao Tong University for the Degree of Master", Jan. 2009, p. 79, Published in: CN.
CNIPA, "Office Action Regarding Chinese Patent Application No. 20171142680.4", dated Mar. 11, 2019, p. 13, Published in: CN.
International Searching Authority, "International Search Report and Written Opinion Re PCT/CN2018/118764", dated Jan. 23, 2019, p. 17, Published in: CN.
International Searching Authority, "International Search Report and Written Opinion Re PCT/CN2018/118766", dated Jan. 14, 2019, p. 18, Published in: CN.
PCT, "International Search Report and Written Opinion Regarding International Application No. PCT/CN2018/117766", dated Jun. 11, 2019, p. 21, Published in: CN.
Zhao, Yi et al., "Multi-Channel Audio Signal Retrieval Based on Multi-Factor Data Mining With Tensor Decomposition", "Proceedings of the 19th International Conference on Digital Signal Processing", Aug. 20, 2014, p. 5.
Wang, Linglin, "First office action of Chinese application No. 201711168514.8", dated Jun. 3, 2020, p. 20, Published in: CN.
Burchett, Stefanie, "Extended European search report of counterpart EP application No. 18881136.8", dated Jun. 16, 2020, p. 7, Published in: EP.
Nakano Kota, et al; "Vocal Manipulation Based on Pitch Transcription and Its Application to Interactive Entertainment for Karaoke", International Conference on Financial Cryptography and Data Security; [Lecture Notes in Computer Sci Ence; Lect. Notes Computer], Aug. 25, 2011,pp. 52-60, Publisher: Springer, Published in: Berlin, Heidelberg, entire document.
Axel Roebel, et al; "Efficient Spectral Envelope Estimation and its application to pitch shifting and envelope preservation", International Conference on Digital Audio Effects Proc. of the 8 th Int. Conference on Digital Audio Effects (DAFX'05), Sep. 22, 2005, pp. 30-35, Published in: Madrid, Spain, entire document.

* cited by examiner

AUDIO SIGNAL PROCESSING METHOD AND APPARATUS, AND STORAGE MEDIUM THEREOF

CROSS-REFERENCE TO RELATED APPLICATION

This application is a National Stage of International Application No. PCT/CN2018/115928, filed on Nov. 16, 2018, which claims priority to Chinese Patent Application No. 201711168514.8, filed on Nov. 21, 2017 and entitled "AUDIO DATA PROCESSING METHOD AND APPARATUS, AND STORAGE MEDIUM", which is hereby incorporated by reference in its entirety.

TECHNICAL FIELD

The present disclosure relates to the field of terminal technologies, and in particular, relates to an audio signal processing method and apparatus, and a storage medium thereof.

BACKGROUND

With the development of the terminal technologies, a terminal supports more and more applications, not only applications implementing basic communication functions but also applications implementing entertainment functions. A user may engage in recreational activities through the applications installed on the terminal for implementing the entertainment functions. For example, the terminal supports a karaoke application, and the user may record a song through the karaoke application installed on the terminal.

SUMMARY

The present disclosure provides an audio signal processing method and apparatus, and a storage medium thereof. The technical solutions are as follows.

In a first aspect, the present disclosure provides an audio signal processing method. The method includes:

acquiring a first audio signal of a target song sung by a user;

extracting timbre information of the user from the first audio signal;

acquiring intonation information of a standard audio signal of the target song; and generating a second audio signal of the target song based on the timbre information and the intonation information.

In a second aspect, the present disclosure provides an audio signal processing apparatus. The apparatus includes: a processor and a memory, wherein at least one program, is stored in the memory and loaded and executed by the processor to perform following processing:

acquire a first audio signal of a target song sung by a user;

extract timbre information of the user from the first audio signal;

acquire intonation information of a standard audio signal of the target song; and generate a second audio signal of the target song based on the timbre information and the intonation information.

In a third aspect, the present disclosure provides a storage medium. At least one instruction, at least one program, a code set or an instruction set is stored in the storage medium, and is loaded and executed by a processor to perform following processing:

acquire a first audio signal of a target song sung by a user;

extract timbre information of the user from the first audio signal;

acquire intonation information of a standard audio signal of the target song; and generate a second audio signal of the target song based on the timbre information and the intonation information.

DETAILED DESCRIPTION

For clearer descriptions of the objectives, the technical solutions and the advantages of the present disclosure, the embodiments of the present disclosure are described in detail hereinafter with reference to the accompanying drawings.

Currently, the terminal directly acquires an audio signal of a target song sung by the user when recording the target song through the karaoke application. The acquired audio signal of the user is taken as an audio signal of the target song.

In the above method, the audio signal of the user is directly used as the audio signal of the target song. However, the audio signal of the target song recorded by the terminal is poor in quality when the user's singing skills are poor.

Figure 1:
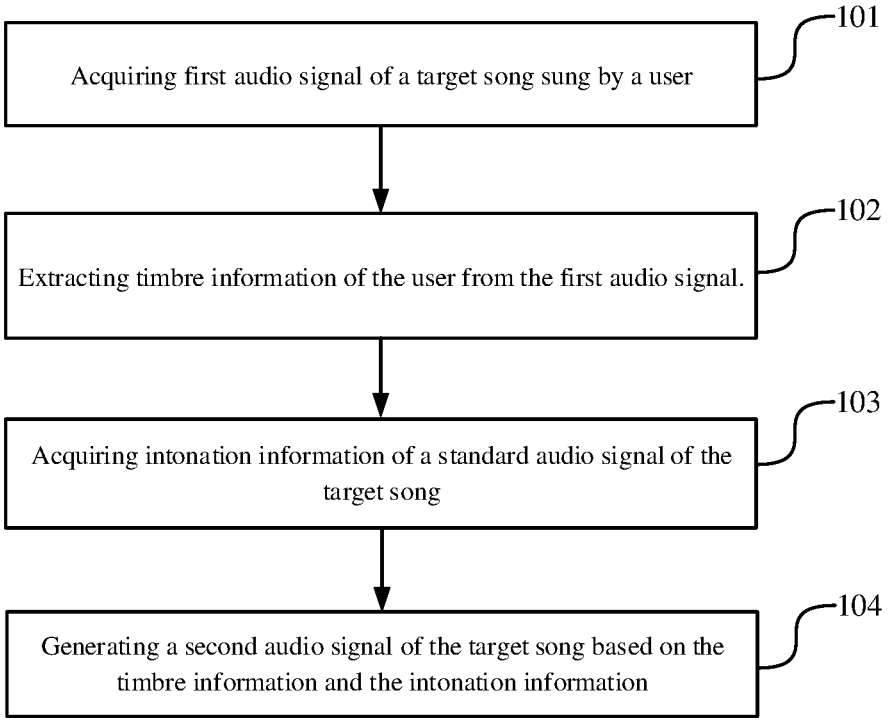
FIG. 1 is a flowchart of an audio signal processing method in accordance with an embodiment of the present disclosure.

An embodiment of the present disclosure provides an audio signal processing method for overcoming the problem that the audio signal of the target song recorded by the terminal is poor. Referring to FIG. 1, the method includes the following steps:

Step 101: acquiring a first audio signal of a target song sung by a user;

Step 102: extracting timbre information of the user from the first audio signal;

Step 103: acquiring intonation information of a standard audio signal of the target song;

Step 104: generating a second audio signal of the target song based on the timbre information and the intonation information.

In a possible implementation, the extracting timbre information of the user from the first audio signal includes:

framing the first audio signal to obtain a framed first audio signal;

windowing the framed first audio signal, performing a short-time Fourier transform (STFT) on an audio signal in a window to obtain a first short-time spectrum signal; and extracting a first spectrum envelope of the first audio signal from the first short-time spectrum signal and taking the first spectrum envelope as the timbre information.

In a possible implementation, the acquiring intonation information of a standard audio signal of the target song includes:

acquiring the standard audio signal of the target song based on a song identifier of the target song, and extracting the intonation information of the standard audio signal from the standard audio signal.

In a possible implementation, the acquiring intonation information of a standard audio signal of the target song includes:

acquiring the intonation information of the standard audio signal of the target song from a corresponding relationship between a song identifier and the intonation information of the standard audio signal based on the song identifier of the target song.

In a possible implementation, the extracting the intonation information of the standard audio signal from the standard audio signal includes:

framing the standard audio signal to obtain a framed second audio signal;

windowing the framed second audio signal, performing an STFT on an audio signal in a window to obtain a second short-time spectrum signal;

extracting a second spectrum envelope of the standard audio signal from the second short-time spectrum signal; and generating an excitation spectrum of the standard audio signal based on the second short-time spectrum signal and the second spectrum envelope, and taking the excitation spectrum as the intonation information of the standard audio signal.

In a possible implementation, the standard audio signal is an audio signal of the target song sung by a designated user, and the designated user is an original singer of the target song or a singer whose intonation meets conditions.

In a possible implementation, the generating a second audio signal of the target song based on the timbre information and the intonation information includes:

obtaining a third short-time spectrum signal by synthesizing the timbre information and the intonation information; and obtaining the second audio signal of the target song by performing an inverse Fourier transform on the third short-time spectrum signal.

In a possible implementation, the obtaining a third short-time spectrum signal by synthesizing the timbre information and the intonation information includes:

determining the third short-time spectrum signal through the following formula I based on a second spectrum envelope corresponding to the timbre information and an excitation spectrum corresponding to the intonation information:

$$Y_i(k)=E_i(k)\cdot\hat{H}_i(k), \text{ wherein} \qquad \text{Formula I:}$$

$Y_i(k)$ is a spectrum value of an $i^{th}$-frame spectrum signal in the third short-time spectrum signal, $E_i(k)$ is an excitation component of the $i^{th}$-frame spectrum, and $\hat{H}_i(k)$ is an envelope value of the $i^{th}$-frame spectrum.

In the embodiment of the present disclosure, the timbre information of the user is extracted from the first audio signal of the target song sung by the user. The intonation information of the standard audio signal of the target song is acquired. The second audio signal of the target song is generated based on the timbre information and the intonation information. Since the second audio signal of the target song is generated based on the timbre information of the standard audio signal and the intonation information of the user, even if the user's singing skills are poor, a high-quality audio signal may still be generated. Thus, the quality of the generated audio signal is improved.

Figure 2:
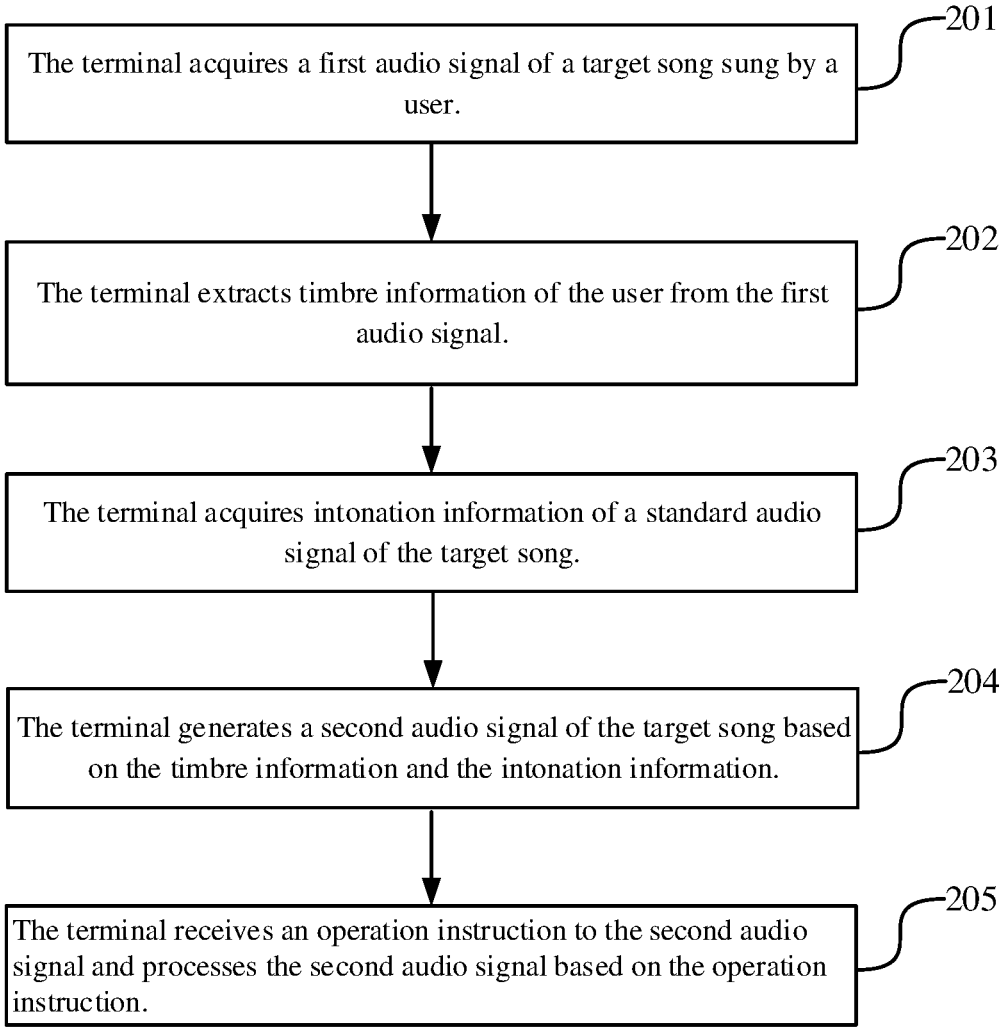
FIG. 2 is a flowchart of another audio signal processing method in accordance with an embodiment of the present disclosure.

An embodiment of the present disclosure provides an audio signal processing method. An execution subject of the method is a client of a designated application or a terminal equipped with the client. The designated application may be an application for recording an audio signal and may also be a social application. The application for recording an audio signal may be a camera application, a vidicon application, a recorder application, a karaoke application or the like. The social application may be an instant messaging application or a live broadcasting application. The terminal may be any device capable of processing an audio signal, such as a mobile phone, a Portable Android device (PAD) or a computer. In this embodiment of the present disclosure, description is given using the scenario where the execution subject is the terminal, and the designated application is the karaoke application as an example. Referring to FIG. 2, the method includes the following steps.

In step 201, the terminal acquires a first audio signal of a target song sung by a user.

The terminal firstly acquires the first audio signal of the target song sung by the user when generating a high-quality audio signal of the target song for the user. The first audio signal may be an audio signal currently recorded by the terminal, an audio signal stored in a local audio library, or an audio signal sent by a friend user of the user. In this embodiment of the present disclosure, the source of the first audio signal is not limited specifically. The target song may be any song and is not limited specifically in this embodiment of the present disclosure, either.

(1) When the first audio signal is the audio signal currently recorded by the terminal, this step may include the following sub-steps: the terminal acquires a song identifier of a target song chosen by the user; and the terminal starts to collect an audio signal when detecting a record start instruction, stops collecting the audio signal when detecting a record end instruction, and uses the collected audio signal as the first audio signal of the target song.

When detecting a record start instruction, the target song is played according to the song identifier of the target song; so the user may sing according to the target song, the accuracy of the first audio signal of the target song sung by a user is improved.

In a possible implementation, a main interface of the terminal includes a plurality of song identifiers from which the user may choose a song. The terminal acquires the song identifier of the song chosen by the user and determines the song identifier of the chosen song as the song identifier of the target song. In another possible implementation, the main interface of the terminal further includes a search input box and a search button. The user may input the song identifier of the target song into the search input box and search the target song through the search button. Correspondingly, the terminal determines the song identifier of a song, input into the search input box, as the song identifier of the target song when detecting that the search button is triggered. The song identifier may be an identifier of the name of the song or an identifier of a singer who sings the song. The identifier of the singer may be the name or the nickname of the singer.

(2) When the first audio signal is the audio signal stored in the local audio library, this step may include the following sub-steps: the terminal acquires a song identifier of a target song chosen by the user, and acquires the first audio signal of the target song sung by the user from the local audio library based on the song identifier of the target song.

A corresponding relationship between the song identifier and the audio signal is stored in the local audio library. Correspondingly, the terminal acquires the first audio signal of the target song from the corresponding relationship between the song identifier and the audio signal based on the song identifier of the target song. The song identifier and the audio signal of the song sung by the user are stored in the local audio library.

(3) When the first audio signal is the audio signal sent by the friend user of the user, this step may be that the terminal chooses the first audio signal sent by the friend user from a chat dialog box of the user and the friend user.

In step 202, the terminal extracts timbre information of the user from the first audio signal.

The first audio signal includes a spectrum envelope that indicates the timbre information and an excitation spectrum that indicates intonation information. The timbre information includes a timbre. This step may be implemented by the following sub-steps (1) to (3).

(1) The terminal frames the first audio signal to obtain a framed first audio signal.

The terminal frames the first audio signal based on a first preset frame size and a first preset frame shift to obtain the framed first audio signal. The duration of each frame of the framed first audio signal in a time domain is the first preset frame size. In two adjacent frames of the first audio signal, a difference between the end time of the previous frame of the first audio signal in the time domain and the start time of the next frame of the first audio signal is the first preset frame shift.

Both of the first preset frame size and the first preset frame shift may be set and changed as required, and neither of them is limited specifically in this embodiment.

(2) The terminal windows the framed first audio signal, performs an STFT on an audio signal in a window to obtain a first short-time spectrum signal.

In this embodiment of the present disclosure, the framed first audio signal is windowed by a Hamming window. The STFT is performed on the audio signal in the window with shift of the window. An audio signal in the time domain is converted into an audio signal in a frequency domain to obtain the first short-time spectrum signal.

(3) The terminal extracts a first spectrum envelope of the first audio signal from the first short-time spectrum signal and takes the first spectrum envelope as the timbre information of the user.

The terminal extracts the first spectrum envelope of the first audio signal from the first short-time spectrum signal by a cepstrum method.

In step 203, the terminal acquires intonation information of a standard audio signal of the target song.

In this embodiment of the present disclosure, the terminal may currently extract the intonation information from the standard audio signal of the target song, which is a first implementation. The terminal also may extract the intonation information of the target song in advance and directly acquires the intonation information of the stored standard audio signal of the target song in this step, which is a second implementation. A server may extract the intonation information of the target song in advance and the terminal acquires the intonation information of the standard audio signal of the target song from the server in this step, which is a third implementation.

In the first implementation, this step may be implemented by the following sub-steps (1) to (2).

(1) The terminal acquires the standard audio signal of the target song based on a song identifier of the target song.

In a possible implementation, a plurality of song identifiers and standard audio signals are relevantly stored in a song library of the terminal. In this step, the terminal acquires the standard audio signal of the target song from a corresponding relationship between the song identifiers and the standard audio signals in the song library based on the song identifier of the target song. The standard audio signal of the target song, stored in the song library, is an audio signal of the target song sung by a designated user. The designated user is an original singer of the target song or a singer whose intonation meets the conditions.

A plurality of songs and audio signal libraries are relevantly stored in the terminal. The audio signal library corresponding to any song includes a plurality of audio signals of the song. In this step, the terminal acquires the audio signal library of the target song from the corresponding relationship between the song identifier and the audio signal library based on the song identifier of the target song and acquires the standard audio signal of the singer whose intonation meets the conditions from the audio signal library.

The step that the terminal acquires the standard audio signal of the singer whose intonation meets the conditions from the audio signal library may include the following sub-steps: the terminal determines the intonation of each audio signal in the audio signal library and chooses the audio signal of the target song sung by the designated user whose intonation meets the conditions from the audio signal library based on the intonation of each audio signal.

The singer whose intonation meets the conditions refers to a singer whose intonation is greater than a preset threshold, or a singer with the best intonation in a plurality of singers.

In another possible implementation node, there may be no song library stored in the terminal, and the terminal acquires the standard audio signal of the target song from the server. Correspondingly, the step that the terminal acquires the standard audio signal of the target song based on the song identifier of the target song may include the following sub-steps: the terminal sends a first acquisition request that carries the song identifier of the target song to the server; and the server receives the first acquisition request from the terminal, acquires the standard audio signal of the target song based on the song identifier of the target song and sends the standard audio signal of the target to the terminal.

It should be noted that since there may be a plurality of singers who have sung the target song, the standard audio signals of the target song sung by the plurality of singers are stored in the server. In this step, the user may also designate the singer. Correspondingly, the first acquisition request may further carry a user identifier of the designated user. The server acquires the standard audio signal of the target song sung by the designated user based on the user identifier of the designated user and the song identifier of the target song and sends the standard audio signal of the target song sung by the designated user to the terminal.

(2) The terminal extracts intonation information of the standard audio signal from the standard audio signal.

The standard audio signal includes a spectrum envelope that indicates the timbre information and an excitation spectrum that indicates the intonation information. The intonation information includes pitch and length. Correspondingly, this step may be implemented by the following sub-steps (2-1) to (2-4).

(2-1) The terminal frames the standard audio signal to obtain a framed second audio signal.

The terminal frames the standard audio signal based on a second preset frame size and a second preset frame shift to obtain the framed second audio signal. The duration of each frame of the framed second audio signal in a time domain is the second preset frame size. In two adjacent frames of the second audio signal, a difference between the end time of the previous frame of the second audio signal in the time domain and the start time of the next frame of the second audio signal is the second preset frame shift.

The second preset frame size and the first preset frame size may be the same or different, and the second preset frame shift and the first preset frame shift may be the same or different. Moreover, both of the second preset frame size and the second preset frame shift may be set and changed as required, and neither of them is limited specifically in this embodiment of the present disclosure.

(2-2) The terminal windows the framed second audio signal, performs an STFT on an audio signal in a window to obtain a second short-time spectrum signal.

In this embodiment of the present disclosure, the framed second audio signal is windowed by a Hamming window. The STFT is performed on the audio signal in the window with shift of the window. An audio signal in the time domain is converted into an audio signal in a frequency domain to obtain the second short-time spectrum signal.

(2-3) The terminal extracts a second spectrum envelope of the standard audio signal from the second short-time spectrum signal.

The terminal extracts the second spectrum envelope of the standard audio signal from the second short-time spectrum signal by a cepstrum method.

(2-4) The terminal generates the excitation spectrum of the standard audio signal based on the second short-time spectrum signal and the second spectrum envelope and takes the excitation spectrum as the intonation information of the stand audio signal.

For each frame spectrum, the terminal determines an excitation component of the frame spectrum based on a spectrum value and an envelope value of the frame spectrum, and forms an excitation spectrum by the excitation component of each frame spectrum. The terminal determines a ratio of the spectrum value to the envelope value of the frame spectrum, and determines the ratio as the excitation component of the frame spectrum.

For example, an $i^{th}$-frame spectrum has the spectrum value of $X_i(k)$, the envelope value of $H_i(k)$, and the excitation component of $$E_i(k) = \frac{X_i(k)}{H_i(k)},$$

and i is a frame number.

In the second implementation, the terminal extracts the intonation information of the standard audio signal of each song in the song library in advance, and relevantly stores the corresponding relationship between the song identifier of each song and the intonation information. Correspondingly, in this step, the terminal acquires the intonation information of the standard audio signal of the target song from the corresponding relationship between the song identifier and the intonation information of the standard audio signal based on the song identifier of the target song.

It should be noted that the process in which the terminal extracts the intonation information of the standard audio signal of each song in the song library is the same as the foregoing process in which the terminal extracts the intonation information of the standard audio signal of the target song, and thus, will not be repeated herein.

In this embodiment of the present disclosure, the terminal may also synthesize the intonation information of the target song sung by the friend user of the user and the timbre information of the user into the second audio signal of the target song. Correspondingly, the step that the terminal acquires the intonation information of the standard audio signal of the target song may include the following sub-steps.

The terminal acquires the audio signal sent by the friend user of the user, takes it as the standard audio signal, and extracts the intonation of the standard audio signal from the standard audio signal.

In the third implementation, step 203 may include the following sub-steps: The terminal sends a second acquisition request to the server; the second acquisition request carries the song identifier of the target song and is configured to acquire the intonation information of the standard audio signal of the target song; the server receives the second acquisition request, acquires the intonation information of the standard audio signal of the target song based on the song identifier of the target song, and sends the intonation information of the standard audio signal of the target song to the terminal; and the terminal receives the intonation information of the standard audio signal of the target song.

It should be noted that prior to this step, the server acquires the intonation information of the standard audio signal of the target song, relevantly stores the song identifier of the target song and the intonation information of the standard audio signal of the target song.

In addition, it should be noted that the server may extract and store the intonation information of the standard audio signals of the target song sung by a plurality of singers in advance. In this step, the user may also designate the singer. Correspondingly, the second acquisition request further carries a user identifier of the designated user. The server acquires the intonation information of the standard audio signal of the target song sung by the designated user based on the user identifier of the designated user and the song identifier of the target song and sends the standard audio signal of the target song sung by the designated user to the terminal.

The steps by which the server extracts the intonation information of the standard audio signal of the target song may be the same as or different from the steps by which the terminal extracts the intonation information of the standard audio signal of the target song, which is not specifically limited in this embodiment of the preset disclosure.

In this embodiment of the preset disclosure, the intonation information of the original singer or the singer with high singing skills and the timbre information of the user may be synthesized into a high-quality song, and in addition, the audio signal of the friend user of the user may serve as a reference audio signal, thus, the intonation information of the target song sung by the user and the timbre information of the user may be synthesized into the high-quality song, which improves the interestingness.

In step 204, the terminal generates a second audio signal of the target song based on the timbre information and the intonation information.

This step may be implemented by the following sub-steps (1) and (2).

(1) The terminal synthesizes the timbre information and the intonation information into a third short-time spectrum signal.

The terminal determines the third short-time spectrum signal through the following formula I based on the second spectrum envelope and the excitation spectrum:

$$Y_i(k)=E_i(k)\cdot\hat{H}_i(k), \text{ wherein} \qquad \text{Formula I:}$$

$Y_i(k)$ is a spectrum value of an $i^{th}$-frame spectrum in the third short-time spectrum signal, $E_i(k)$ is an excitation component of the $i^{th}$-frame spectrum, and $\hat{H}_i(k)$ is an envelope value of the $i^{th}$-frame spectrum.

(2) The terminal performs the inverse Fourier transform on the third short-time spectrum signal to obtain a second audio signal of the target song.

The terminal performs the inverse Fourier transform on the third short-time spectrum signal to transform the third short-time spectrum signal into a time-domain signal so as to obtain the second audio signal of the target song.

It should be noted that the terminal may end after generating the second audio signal of the target song. In addition, the terminal may further perform step 205 to process the second audio signal after generating the second audio signal of the target song.

In step 205, the terminal receives an operation instruction to the second audio signal and processes the second audio signal based on the operation instruction.

The user may trigger the operation instruction to the second audio signal for the terminal when the terminal generates the second audio signal of the target song. The operation instruction may be a storage instruction for instructing the terminal to store the second audio signal, a first sharing instruction for instructing the terminal to share the second audio signal with a target user and a second sharing instruction for instructing the terminal to share the second audio signal with an information exhibiting platform of the user.

(1) When the operation instruction is the storage instruction, the terminal may process the second audio signal based on the operation instruction by the following sub-step: the terminal stores the second audio signal in a designated storage space based on the operation instruction. The designated storage space may be the local audio library of the terminal and may also be a storage space corresponding to a user account of the user in a cloud server.

When the designated storage space is the storage space corresponding to the user account of the user in a cloud server, the terminal stores the second audio signal in the designated storage space based on the operation instruction by the following step: the terminal sends a storage request, which carries the user identifier and the second audio signal, to the cloud server; and the cloud server receives the storage request and stores the second audio signal in the storage space corresponding to the user identifier based on the user identifier.

Before the terminal stores the second audio signal in the storage space corresponding to the user account of the user in the cloud server, the cloud server performs an authentication on the terminal. After passing the authentication, the terminal performs the subsequent storage. The cloud server may perform the authentication on the terminal by the following steps: the terminal sends an authentication request that carries the user account and a user password of the user to the cloud server; the cloud server receives the authentication request sent by the terminal; the user passes the authentication when the user account matches the user password; and the user fails to pass the authentication when the user account does not match the user password.

In this embodiment of the present disclosure, the authentication is performed on the user first before the second audio signal is stored in the cloud server. The subsequent storage process is performed after the user passes the authentication. Thus, the safety of the second audio signal is improved.

(2) When the operation instruction is the first sharing instruction, the terminal may process the second audio signal based on the operation instruction by the following steps: the terminal acquires the target user chosen by the user, and sends the second audio signal and the user identifier of the target user to the server; and the server receives the second audio signal and the user identifier of the target user, and sends the second audio signal to the terminal corresponding to the target user based on the user identifier of the target user. The target user includes at least one user and/or at least one group.

(3) When the operation instruction is the second sharing instruction, the terminal may process the second audio signal based on the operation instruction by the following steps: the terminal sends the second audio signal and the user identifier of the user to the server; and the server receives the second audio signal and the user identifier of the user and shares the second audio signal with the information exhibiting platform of the user based on the user identifier of the user.

The user identifier may be the user account registered by the user in the server in advance or the like. A group identifier may be a group name, a quick response (QR) code or the like. It should be noted that in this embodiment of the present disclosure, an audio signal processing function is added to the social application, such that the functions of the social application are enriched and the user experience is improved.

In the embodiment of the present disclosure, the timbre information of the user is extracted from the first audio signal of the target song sung by the user. The intonation information of the standard audio signal of the target song is acquired. The second audio signal of the target song is generated based on the timbre information and the intonation information. Since the second audio signal of the target song is generated based on the timbre information of the standard audio signal and the intonation information of the user, even if the user's singing skills are poor, a high-quality audio signal may still be generated. Thus, the quality of the generated audio signal is improved.

Figure 3:
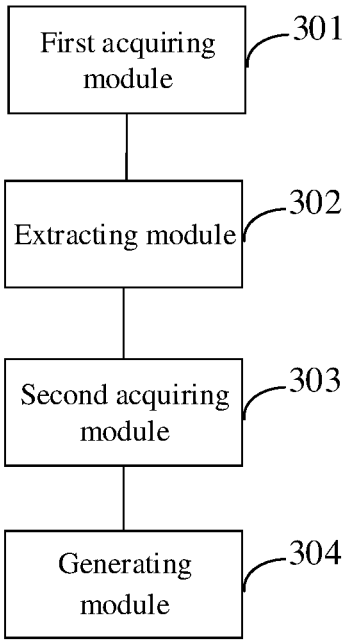
FIG. 3 is a schematic structural diagram of an audio signal processing apparatus in accordance with an embodiment of the present disclosure.

An embodiment of the present disclosure provides an audio signal processing apparatus applied to a terminal and configured to perform the steps performed by the terminal in the audio signal processing method above. Referring to FIG. 3, the apparatus includes:

a first acquiring module 301, configured to acquire a first audio signal of a target song sung by a user;

an extracting module 302, configured to extract timbre information of the user from the first audio signal;

a second acquiring module 303, configured to acquire intonation information of a standard audio signal of the target song; and a generating module 304, configured to generate a second audio signal of the target song based on the timbre information and the intonation information.

In a possible implementation, the extracting module 302 is further configured to: frame the first audio signal to obtain a framed first audio signal; window the framed first audio signal, perform an STFT on an audio signal in a window to obtain a first short-time spectrum signal; and extract a first spectrum envelope of the first audio signal from the first short-time spectrum signal and take the first spectrum envelope as the timbre information.

In a possible implementation, the second acquiring module 303 is further configured to acquire the standard audio signal of the target song based on a song identifier of the target song, and to extract the intonation information of the standard audio signal from the standard audio signal; or the second acquiring module 303 is further configured to acquire the intonation information of the standard audio signal of the target song from a corresponding relationship between a song identifier and the intonation information of the standard audio signal based on the song identifier of the target song.

In a possible implementation, the second acquiring module 303 is further configured to: frame the standard audio signal to obtain a framed second audio signal; window the framed second audio signal, perform an STFT on an audio signal in a window to obtain a second short-time spectrum signal; extract a second spectrum envelope of the standard audio signal from the second short-time spectrum signal; and generate an excitation spectrum of the standard audio signal based on the second short-time spectrum signal and the second spectrum envelope, and take the excitation spectrum as the intonation information of the standard audio signal.

In a possible implementation, the standard audio signal is an audio signal of the target song sung by a designated user, and the designated user is an original singer of the target song or a singer whose intonation meets the conditions.

In a possible implementation, the generating module 304 is further configured to: synthesize the timbre information and the intonation information into a third short-time spectrum signal; and perform inverse Fourier transform on the third short-time spectrum signal to obtain the second audio signal of the target song.

In a possible implementation, the generating module 304 is further configured to determine the third short-time spectrum signal through the following formula I based on a second spectrum envelope corresponding to the timbre information and an excitation spectrum corresponding to the intonation information:

$$Y_i(k)=E_i(k)\cdot\hat{H}_i(k), \text{ wherein} \qquad \text{Formula I:}$$

$Y_i(k)$ is a spectrum value of an $i^{th}$-frame spectrum in the third short-time spectrum signal, $E_i(k)$ is an excitation component of the $i^{th}$-frame spectrum, and $\hat{H}_i(k)$ is an envelope value of the $i^{th}$-frame spectrum.

In the embodiment of the present disclosure, the timbre information of the user is extracted from the first audio signal of the target song sung by the user. The intonation information of the standard audio signal of the target song is acquired. The second audio signal of the target song is generated based on the timbre information and the intonation information. Since the second audio signal of the target song is generated based on the timbre information of the standard audio signal and the intonation information of the user, even if the user's singing skills are poor, a high-quality audio signal may still be generated. Thus, the quality of the generated audio signal is improved.

It should be noted that the audio signal processing device provided by this embodiment only takes division of all the functional modules as an example for explanation during processing of the audio signal. In practice, the above functions may be implemented by the different functional modules as required. That is, the internal structure of the device is divided into different functional modules to finish all or part of the functions described above. In addition, the audio signal processing device provided by this embodiment has the same concept as the audio signal processing method provided by the foregoing embodiment. Reference may be made to the method embodiment for the specific implementation process of the device, which is not repeated herein.

Figure 4:
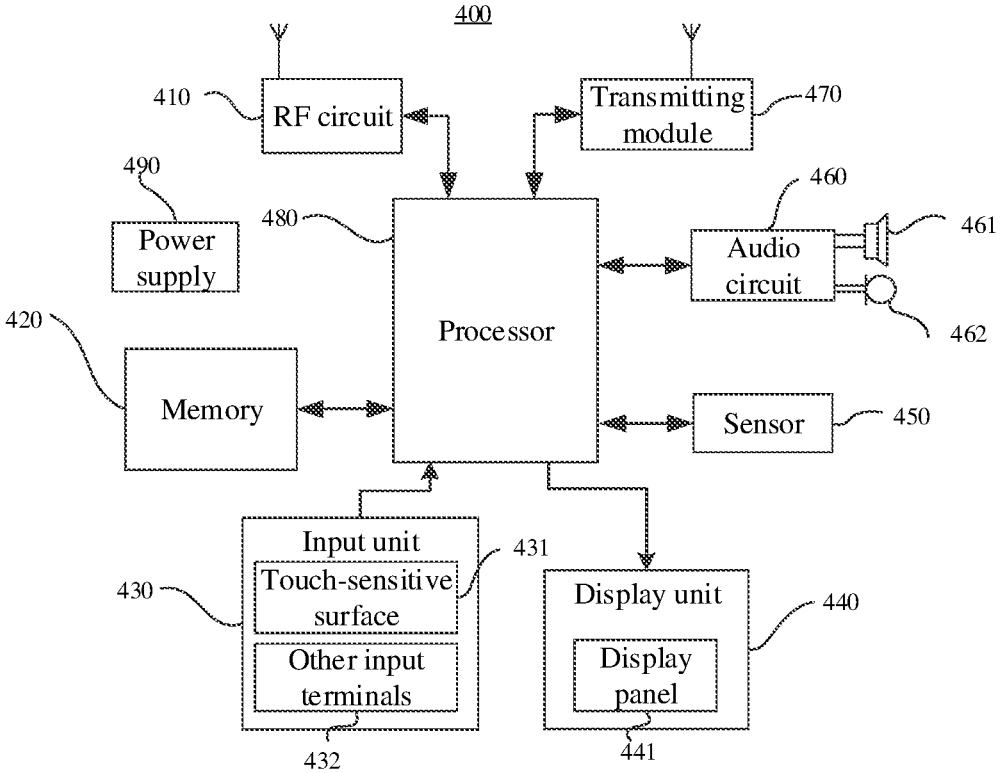
FIG. 4 is a schematic structural diagram of a terminal in accordance with an embodiment of the present disclosure.

FIG. 4 is a schematic structural diagram of a terminal in accordance with an embodiment of the present disclosure. The terminal may be configured to implement functions executed by the terminal in the audio signal processing method in the foregoing embodiment.

The terminal 400 may include a radio frequency (RF) circuit 410, a memory 420 including one or more computer-readable storage media, an input unit 430, a display unit 440, a sensor 450, an audio circuit 460, a transmitting module 470, a processor 480 including one or more processing centers, a power supply 490, or the like It may be understood by those skilled in the art that the terminal structure shown in FIG. 4 is not a limitation to the terminal. The terminal may include more or less components than those illustrated in FIG. 4, a combination of some components or different component layouts.

The RF circuit 410 may be configured to receive and send messages or to receive and send a signal during a call, in particular, to hand over downlink information received from a base station to one or more processors 480 for processing, and furthermore, to transmit uplink data to the base station. Usually, the RF circuit 410 includes but not limited to an antenna, at least one amplifier, a tuner, one or more oscillators, a subscriber identification module (SIM) card, a transceiver, a coupler, a low noise amplifier (LNA), a duplexer, etc. Besides, the RF circuit 410 may further communicate with a network and other terminals through radio communication which may use any communication standard or protocol, including but not limited to global system of mobile communications (GSM), general packet radio service (GPRS), code division multiple access (CDMA), wideband code division multiple access (WCDMA), long term evolution (LTE), e-mails and short messaging service (SMS).

The memory 420 may be configured to store a software program and a module, such as the software programs and the modules corresponding to the terminal shown in the foregoing exemplary embodiment. The processor 480 executes various function applications and data processing, for example, video-based interaction, by running the software programs and the modules, which are stored in the memory 420. The memory 420 may mainly include a program storage area and a data storage area. The program storage area may store an operation system, an application required by at least one function (such as an audio playback function and an image playback function). The data storage area may store data (such as audio data and a phone book) built based on the use of the terminal 400. Moreover, the memory 420 may include a high-speed random-access memory and may further include a nonvolatile memory, such as at least one disk memory, a flash memory or other volatile solid state memories. Correspondingly, the memory 420 may further include a memory controller to provide access to the memory 420 by the processor 480 and the input unit 430.

The input unit 430 may be configured to receive input digital or character information and to generate keyboard, mouse, manipulator, optical or trackball signal inputs related to user settings and functional control. In particular, the input unit 430 may include a touch-sensitive surface 431 and other input terminals 432. The touch-sensitive surface 431 is also called a touch display screen or a touch panel, may collect touch operations (for example, operations on or near the touch-sensitive surface 431 by the user with any appropriate object or accessory like a finger, a touch pen or the like) on or near the touch-sensitive surface by a user and may also drive a corresponding linkage device based on a preset driver. Optionally, the touch-sensitive surface 431 may include two portions, namely a touch detection device and a touch controller. The touch detection device detects a touch orientation of the user and a signal generated by a touch operation, and transmits the signal to the touch controller. The touch controller receives touch information from the touch detection device, converts the received touch information into contact coordinates, sends the contact coordinates to the processor 480, and receives and executes a command sent by the processor 480. In addition, the touch-sensitive surface 431 may be practiced by resistive, capacitive, infrared, surface acoustic wave (SAW) or other types of touch surfaces. In addition to the touch-sensitive surface 431, the input unit 430 may further include other input terminals 432. In particular, these other input terminals 432 may include but not limited to one or more of a physical keyboard, function keys (such as a volume control key and a switch key), a trackball, a mouse, a manipulator, or the like.

The display unit 440 may be configured to display information input by the user or information provided for the user and various graphic user interfaces of the terminal 400. These graphic user interfaces may be constituted by graphs, texts, icons, videos and any combination thereof. The display unit 440 may include a display panel 441. Optionally, such forms as a liquid crystal display (LCD) and an organic light-emitting diode (OLED) may be adopted to configure the display panel 441. Further, the touch-sensitive surface 431 may cover the display panel 441. The touch-sensitive surface 431 transmits a detected touch operation on or near itself to the processor 480 to determine the type of a touch event. After that, the processor 480 provides a corresponding visual output on the display panel 441 based on the type of the touch event. Although the touch-sensitive surface 431 and the display panel 441 in FIG. 4 are two independent components for achieving input and output functions, in some embodiments, the touch-sensitive surface 431 and the display panel 441 may be integrated to achieve the input and output functions.

The terminal 400 may further include at least one sensor 450, such as a photo-sensor, a motion sensor and other sensors. In particular, the photo-sensor may include an ambient light sensor and a proximity sensor. The ambient light sensor may adjust the luminance of the display panel 441 based on the brightness of ambient light. The proximity sensor may turn off the display panel 441 and/or a backlight when the terminal 400 moves to an ear. As one of the motion sensors, a gravity acceleration sensor may detect accelerations in all directions (generally, three axes), may also detect the magnitude and the direction of gravity when in still, and may be applied to mobile phone attitude recognition applications (such as portrait and landscape switching, related games and magnetometer attitude correction), relevant functions of vibration recognition (such as a pedometer and knocking), or the like. Other sensors such as a gyroscope, a barometer, a hygrometer, a thermometer and an infrared sensor, which may be configured for the terminal 400, are not described herein any further.

The audio circuit 460, a speaker 461 and a microphone 462 may provide an audio interface between the user and the terminal 400. In one aspect, the audio circuit 460 may transmit an electrical signal converted from the received audio data to the speaker 461, and the electrical signal is converted by the speaker 461 into an acoustical signal for outputting. In another aspect, the microphone 462 converts the collected acoustical signal into an electrical signal, the audio circuit 460 receives the electrical signal, converts the received electrical signal into audio data, and outputs the audio data to the processor 480 for processing, and the processed audio data is transmitted to another terminal by the RF circuit 410. Alternatively, the audio data is output to the memory 420 to be further processed. The audio circuit 460 may further include an earplug jack to provide a communication between an external earphone and the terminal 400.

The terminal 400 may help the user to send and receive an e-mail, browse a website and access streaming media through the transmitting module 470 and provides radio or cable broadband Internet access for the user. It may be understood that the transmitting module 470 shown in FIG. 4 is not a necessary component of the terminal 400 and may be completely omitted as required without changing the essence of the present disclosure.

The processor 480 is a control center of the terminal 400, links all portions of an entire mobile phone by various interfaces and circuits. By running or executing the software programs and/or the modules stored in the memory 420 and invoking data stored in the memory 420, the processor executes various functions of the terminal and processes the data so as to wholly monitor the mobile phone. Optionally, the processor 480 may include one or more processing centers. Preferably, the processor 480 may be integrated with an application processor and a modulation and demodulation processor. The application processor is mainly configured to process the operation system, a user interface, an application, etc. The modulation and demodulation processor is mainly configured to process radio communication. Understandably, the modulation and demodulation processor may not be integrated with the processor 480.

The terminal 400 may further include the power supply 490 (for example, a battery) for powering up all the components. Preferably, the power supply is logically connected to the processor 480 through a power management system to manage charging, discharging, power consumption, or the like. through the power management system. The power supply 490 may further include one or more of any of the following components: a direct current (DC) or alternating current (AC) power supply, a recharging system, a power failure detection circuit, a power converter or inverter and a power state indicator.

Although not shown, the terminal 400 may further include a camera, a Bluetooth module, or the like, which is not repeated herein. Particularly in this embodiment, the display unit of the terminal 400 is a touch screen display and further includes a memory 420 and one or more programs. The one or more programs are stored in the memory 420. One or more processors 480 are configured to execute the instructions, included by the one or more programs, for implementing the operations executed by the terminal in the above-described embodiments;

wherein the at least one program is loaded and executed by the processor 480 to perform following processing:

acquire a first audio signal of a target song sung by a user;

extract timbre information of the user from the first audio signal;

acquire intonation information of a standard audio signal of the target song; and generate a second audio signal of the target song based on the timbre information and the intonation information.

In a possible implementation, the at least one program is loaded and executed by the processor 480 to perform following processing:

frame the first audio signal to obtain a framed first audio signal;

window the framed first audio signal, perform a short-time Fourier transform (STFT) on an audio signal in a window to obtain a first short-time spectrum signal; and extract a first spectrum envelope of the first audio signal from the first short-time spectrum signal and taking the first spectrum envelope as the timbre information.

In a possible implementation, the at least one program is loaded and executed by the processor 480 to perform following processing:

acquire the standard audio signal of the target song based on a song identifier of the target song, and extracting the intonation information of the standard audio signal from the standard audio signal.

In a possible implementation, the at least one program is loaded and executed by the processor 480 to perform following processing: acquire the intonation information of the standard audio signal of the target song from a corresponding relationship between a song identifier and the intonation information of the standard audio signal based on the song identifier of the target song.

In a possible implementation, the at least one program is loaded and executed by the processor 480 to perform following processing:

frame the standard audio signal to obtain a framed second audio signal;

window the framed second audio signal, performing an STFT on an audio signal in a window to obtain a second short-time spectrum signal;

extract a second spectrum envelope of the standard audio signal from the second short-time spectrum signal; and generate an excitation spectrum of the standard audio signal based on the second short-time spectrum signal and the second spectrum envelope, and taking the excitation spectrum as the intonation information of the standard audio signal.

In a possible implementation, wherein the standard audio signal is an audio signal of the target song sung by a designated user, and the designated user is an original singer of the target song or a singer whose intonation meets conditions.

In a possible implementation, the at least one program is loaded and executed by the processor 480 to perform following processing:

obtain a third short-time spectrum signal by synthesizing the timbre information and the intonation information; and obtain the second audio signal of the target song by performing an inverse Fourier transform on the third short-time spectrum signal.

In a possible implementation, the at least one program is loaded and executed by the processor 480 to perform following processing:

determining the third short-time spectrum signal through the following formula I based on a second spectrum envelope corresponding to the timbre information and an excitation spectrum corresponding to the intonation information:

$$Y_i(k)=E_i(k)\cdot\hat{H}_i(k), \text{ wherein} \qquad \text{Formula I:}$$

$Y_i(k)$ is a spectrum value of an $i^{th}$-frame spectrum signal in the third short-time spectrum signal, $E_i(k)$ is an excitation component of the $i^{th}$-frame spectrum, and $\hat{H}_i(k)$ is an envelope value of the $i^{th}$-frame spectrum.

In an exemplary embodiment, a computer-readable storage medium with a computer program stored therein, for example, a memory with a computer program stored therein, is further provided. The audio signal processing method in the above-mentioned embodiment is performed when the computer program is executed by a processor. For example, the computer-readable storage medium may be a read-only memory (ROM), a random-access memory (RAM), or a compact disc read-only memory (CD-ROM), a tape, a floppy disk, an optical data storage device, or the like.

Persons of ordinary skill in the art may understand that all or part of the steps described in the above embodiments may be completed through hardware, or through relevant hardware instructed by applications stored in a non-transitory computer readable storage medium, such as a read-only memory, a disk or a CD, or the like.

Detailed above are merely exemplary embodiments of the present disclosure, and are not intended to limit the present disclosure. Within the spirit and principles of the disclosure, any modifications, equivalent substitutions, improvements or the like, are within the protection scope of the present disclosure.

What is claimed is:

1. An audio signal processing method, comprising:

acquiring a first audio signal of a target song sung by a user;

extracting timbre information of the user from the first audio signal;

acquiring intonation information of a standard audio signal of the target song; and generating a second audio signal of the target song based on the timbre information and the intonation information;

wherein the acquiring intonation information of a standard audio signal of the target song comprises:

framing the standard audio signal to obtain a framed second audio signal;

windowing the framed second audio signal, performing a short-time Fourier transform (STFT) on an audio signal in a window to obtain a second short-time spectrum signal;

extracting a second spectrum envelope of the standard audio signal from the second short-time spectrum signal; and generating an excitation spectrum of the standard audio signal based on the second short-time spectrum signal and the second spectrum envelope, and taking the excitation spectrum as the intonation information of the standard audio signal.

2. The method according to claim 1, wherein the acquiring timbre information of the user from the first audio signal comprises:

framing the first audio signal to obtain a framed first audio signal;

windowing the framed first audio signal, performing a short-time Fourier transform (STFT) on an audio signal in a window to obtain a first short-time spectrum signal; and extracting a first spectrum envelope of the first audio signal from the first short-time spectrum signal and taking the first spectrum envelope as the timbre information.

3. The method according to claim 1, wherein the acquiring intonation information of a standard audio signal of the target song comprises:

acquiring the standard audio signal of the target song based on a song identifier of the target song, and extracting the intonation information of the standard audio signal from the standard audio signal.

4. The method according to claim 1, wherein the standard audio signal is an audio signal of the target song sung by a designated user, and the designated user is an original singer of the target song or a singer whose intonation meets conditions.

5. The method according to claim 1, wherein the generating a second audio signal of the target song based on the timbre information and the intonation information comprises:

obtaining a third short-time spectrum signal by synthesizing the timbre information and the intonation information; and obtaining the second audio signal of the target song by performing an inverse Fourier transform on the third short-time spectrum signal.

6. The method according to claim 5, wherein the obtaining a third short-time spectrum signal by synthesizing the timbre information and the intonation information comprises:

determining the third short-time spectrum signal through the following formula I based on a second spectrum envelope corresponding to the timbre information and an excitation spectrum corresponding to the intonation information:

$$Y_i(k)=E_i(k)\cdot\hat{H}_i(k), \text{ wherein} \qquad \text{Formula I:}$$

$Y_i(k)$ is a spectrum value of an $i^{th}$-frame spectrum signal in the third short-time spectrum signal, $E_i(k)$ is an excitation component of the $i^{th}$-frame spec and $\hat{H}_i(k)$ is an envelope value of the $i^{th}$-frame spectrum.

7. The method according to claim 1, wherein the acquiring intonation information of a standard audio signal of the target song comprises:

acquiring the intonation information of the standard audio signal of the target song from a corresponding relationship between a song identifier and the intonation information of the standard audio signal based on the song identifier of the target song.

8. An apparatus for use in audio signal processing, comprising a processor and a memory, wherein at least one program is stored in the memory and loaded and executed by the processor to perform following processing:

acquire a first audio signal of a target song sung by a user;

extract timbre information of the user from the first audio signal;

acquire intonation information of a standard audio signal of the target song; and generate a second audio signal of the target song based on the timbre information and the intonation information;

wherein the at least one program is stored in the memory and loaded and executed by the processor to perform the following processing:

frame the standard audio signal to obtain a framed second audio signal;

window the framed second audio signal, perform a short-time Fourier transform (STFT) on an audio signal in a window to obtain a second short-time spectrum signal;

extract a second spectrum envelope of the standard audio signal from the second short-time spectrum signal; and generate an excitation spectrum of the standard audio signal based on the second short-time spectrum signal and the second spectrum envelope, and taking the excitation spectrum as the intonation information of the standard audio signal.

9. The apparatus according to claim 8, wherein the at least one program is stored in the memory and loaded and executed by the processor to perform following processing:

frame the first audio signal to obtain a framed first audio signal;

window the framed first audio signal, perform a short-time Fourier transform (STFT) on an audio signal in a window to obtain a first short-time spectrum signal; and extract a first spectrum envelope of the first audio signal from the first short-time spectrum signal and taking the first spectrum envelope as the timbre information.

10. The apparatus according to claim 8, wherein the at least one program is stored in the memory and loaded and executed by the processor to perform following processing:

acquire the standard audio signal of the target song based on a song identifier of the target song, and extracting the intonation information of the standard audio signal from the standard audio signal.

11. The apparatus according to claim 8, wherein the at least one program is stored in the memory and loaded and executed by the processor to perform following processing:

acquire the intonation information of the standard audio signal of the target song from a corresponding relationship between a song identifier and the intonation information of the standard audio signal based on the song identifier of the target song.

12. The apparatus according to claim 8, wherein the standard audio signal is an audio signal of the target song sung by a designated user, and the designated user is an original singer of the target song or a singer whose intonation meets conditions.

13. The apparatus according to claim 8, wherein the at least one program is stored in the memory and loaded and executed by the processor to perform following processing:

obtain a third short-time spectrum signal by synthesizing the timbre information and the intonation information; and obtain the second audio signal of the target song by performing an inverse Fourier transform on the third short-time spectrum signal.

14. The apparatus according to claim 13, wherein the at least one program is stored in the memory and loaded and executed by the processor to perform following processing:

determine the third short-time spectrum signal through the following formula I based on a second spectrum envelope corresponding to the timbre information and an excitation spectrum corresponding to the intonation information:

$$Y_i(k)=E_i(k)\cdot\hat{H}_i(k), \text{ wherein} \qquad \text{Formula I:}$$

$Y_i(k)$ is a spectrum value of an $i^{th}$-frame spectrum signal in the third short-time spectrum signal, $E_i(k)$ is an excitation component of the $i^{th}$-frame spectrum, and $\hat{H}_i(k)$ is an envelope value of the $i^{th}$-frame spectrum.

15. A storage medium, wherein at least one program is stored in the storage medium, and is loaded and executed by a processor to perform following processing:

acquire a first audio signal of a target song sung by a user;

extract timbre information of the user from the first audio signal;

acquire intonation information of a standard audio signal of the target song; and generate a second audio signal of the target song based on the timbre information and the intonation information;

wherein the at least one program is stored in the storage medium, and is loaded and executed by the processor to perform the following processing;

frame the standard audio signal to obtain a framed second audio signal;

window the framed second audio signal, perform a short-time Fourier transform (STFT) on an audio signal in a window to obtain a second short-time spectrum signal;

extract a second spectrum envelope of the standard audio signal from the second short-time spectrum signal; and generate an excitation spectrum of the standard audio signal based on the second short-time spectrum signal and the second spectrum envelope, and taking the excitation spectrum as the intonation information of the standard audio signal.

* * * * *